US010357892B2

(12) United States Patent
Smithwick, Jr.

(10) Patent No.: US 10,357,892 B2
(45) Date of Patent: Jul. 23, 2019

(54) ROTARY CUTTING DIE FOR CUTTING CORRUGATED BOARD INCLUDING A DIE BOARD AND AN ATTACHED SUBSTRATE FOR SUPPORTING PRODUCT EJECTORS

(71) Applicant: Container Graphics Corporation, Cary, NC (US)

(72) Inventor: James M Smithwick, Jr., New Bern, NC (US)

(73) Assignee: Container Graphics Corporation, Cary, NC (US)

( * ) Notice: Subject to any disclaimer, the term of this patent is extended or adjusted under 35 U.S.C. 154(b) by 216 days.

(21) Appl. No.: 15/197,029

(22) Filed: Jun. 29, 2016

(65) Prior Publication Data

US 2018/0001505 A1 Jan. 4, 2018

(51) Int. Cl.
*B26D 7/18* (2006.01)
*B26F 1/38* (2006.01)
*B26F 1/44* (2006.01)

(52) U.S. Cl.
CPC ..... *B26F 1/384* (2013.01); *B26D 7/1818* (2013.01); *B26F 1/44* (2013.01); *B26F 2001/4463* (2013.01)

(58) Field of Classification Search
CPC ..... B26F 1/384; B26F 1/44; B26D 7/1818
See application file for complete search history.

(56) References Cited

U.S. PATENT DOCUMENTS 3,827,322 A * 8/1974 Saunders ..... B26D 7/1818 83/128
4,306,476 A * 12/1981 Saunders ..... B26D 7/1818 493/342
5,111,725 A * 5/1992 Simpson ..... B26D 7/1818 493/342
5,488,889 A * 2/1996 Kang ..... B26D 3/085 83/346
6,644,153 B1 * 11/2003 Gordon ..... B26D 7/1818 493/342
2011/0265620 A1 * 11/2011 Kicinski ..... B26D 7/1818 83/27
2013/0344323 A1 * 12/2013 Fujii ..... C09J 163/00 428/337
2017/0028580 A1 * 2/2017 Smithwick, Jr. ..... B26F 1/384

* cited by examiner

*Primary Examiner* — Kenneth E Peterson
*Assistant Examiner* — Liang Dong
(74) *Attorney, Agent, or Firm* — Coats & Bennett PLLC

(57) ABSTRACT

A rotary cutting die including a curved die board having a series of product ejector openings formed completely through the die board. Secured to an inner surface of the die board is a substrate. A series of product ejectors are secured to the substrate and project therefrom through the product ejector openings and past an outer surface of the die board. These product ejectors function to engage a portion of a die cut product passing through the nip and exert a force on the die cut product which assists in separating the die cut product from the rotary cutting die.

23 Claims, 6 Drawing Sheets

ROTARY CUTTING DIE FOR CUTTING CORRUGATED BOARD INCLUDING A DIE BOARD AND AN ATTACHED SUBSTRATE FOR SUPPORTING PRODUCT EJECTORS

FIELD OF THE INVENTION

The present invention relates to rotary cutting dies specifically designed to cut and score corrugated board that is used in making corrugated board boxes.

BACKGROUND

Rotary cutting dies are used to cut and score sheets of corrugated board to produce a die cut product that can be manipulated into boxes. Rotary cutting dies typically include a curved die board that is configured to mount on a die cylinder. When used, the die cylinder and die board are mounted adjacent an anvil and a nip is defined between the cylinder and the anvil. Sheets of corrugated board are fed into and through the nip and, in the process, the sheet of corrugated board is cut and scored to form the die cut product. Die boards commonly include product and scrap cutting blades, scoring rules, trim and scrap strippers and product ejectors for separating the die cut product from the cutting die.

A common problem with rotary cutting dies that operate on corrugated board is that of controlling the pressure exerted against the corrugated board by the product ejectors. If the pressure is too great, the die cut product is damaged. That is, if the pressure is too great, the flutes are crushed. This makes the resulting boxes weaker and hence the boxes possess less stacking strength and the crushed flutes have a negative impact on the appearance of the product.

On the other hand, if the pressure exerted by the product ejectors is too low, then this will impact the separation of the die cut product from the cutting die during the die cutting operation. That is, if the pressure is insufficient to dislodge or remove the cut die product from the cutting die, it follows that the product will continue with the cutting die and the die cutting operation will be seriously impacted.

It is known to attach product ejectors to the outer surface of the die board. It is also known to seat product ejectors on the bottom of an opening formed in the die board. In this latter case, the product ejectors project outwardly through the opening and above the outer surface of the die board. In both cases, the height of the product ejector is limited. It is recognized that the shorter the height of the product ejector, the more challenging it is to control or limit the pressure exerted by the product ejector against the die cut product. Also, there are limitations on the material options for product ejectors. As a practical matter, materials selected for use as product ejectors are materials that have been tried and used and which perform reliably over time in typical die cutting operations.

Thus, there is a need to develop a rotary cutting die cutting corrugated board that addresses the general problem of flute crushing.

SUMMARY OF THE INVENTION

The present invention relates to a rotary cutting die for cutting corrugated board having a substrate secured to an inner surface of a die board which includes one or more product ejector openings formed completely therethrough. One or more product ejectors are secured to the substrate and project from the substrate through the product ejector openings in the die board and past the outer surface of the die board.

In one particular embodiment, the substrate comprises a flexible tape having an adhesive surface that secures the tape to the die board. One or more product ejectors are secured to the adhesive surface of the flexible tape and project outwardly therefrom through the one or more product ejector openings formed in the die board.

Other objects and advantages of the present invention will become apparent and obvious from a study of the following description and the accompanying drawings which are merely illustrative of such invention.

DESCRIPTION OF EXEMPLARY EMBODIMENTS

Figure 1:
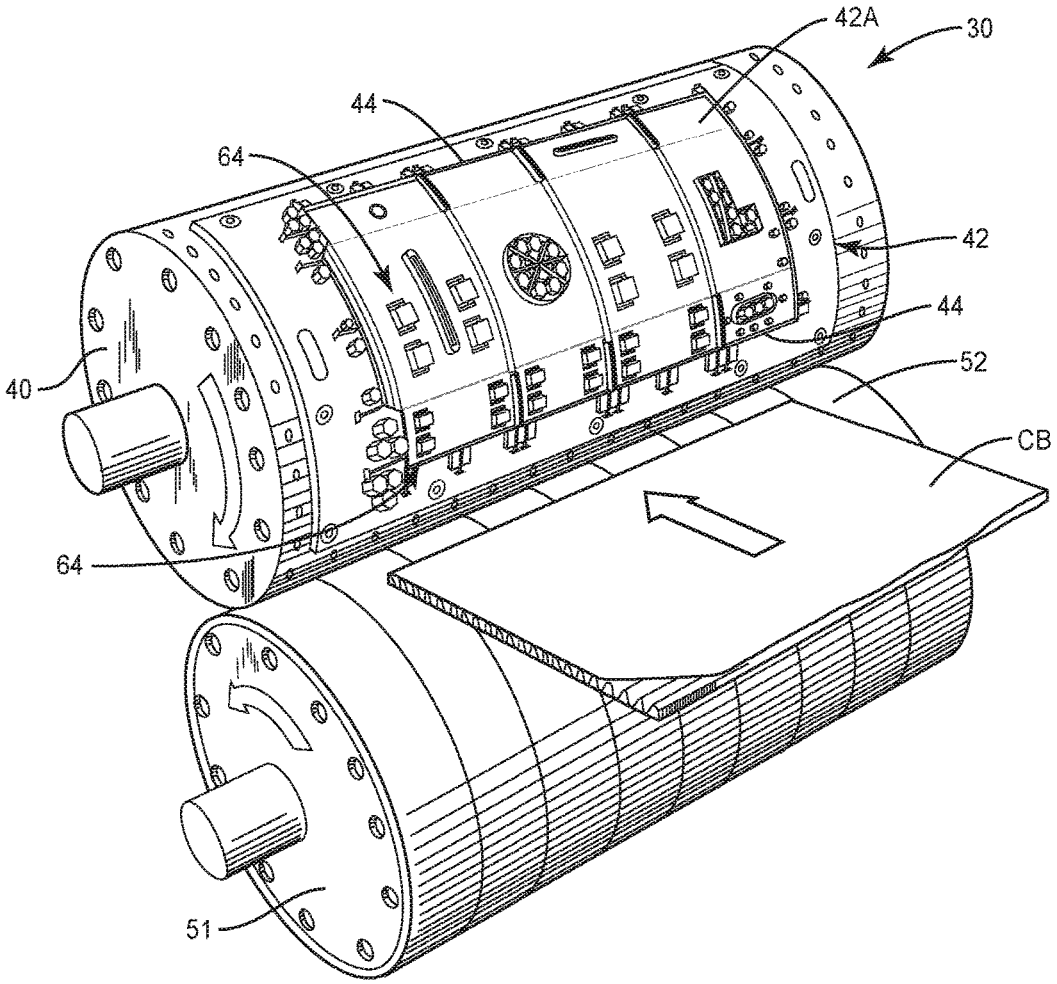
FIG. 1 is a perspective view of a rotary cutting die machine including a rotary cutting die mounted on a die cylinder and an anvil disposed adjacent the die cylinder.

With reference to the drawings and particularly FIG. 1, there is shown therein a rotary cutting die indicated generally by the numeral 30. The rotary cutting die apparatus includes a die board (typically constructed of wood) indicated generally by the numeral 42. Die board 42 includes an outer surface 42A and an inner surface 42B. Die board 42 is adapted to be mounted to the die cylinder 40 that is rotatively mounted adjacent an anvil cylinder 51 having an outer sheath 52. Extending from the outer surface 42A of the die board 42 is a series of product ejectors 64. Disposed around the die board 42 are one or more blades 44. These blades are referred to as product cutting blades as they produce a die cut product as opposed to cutting blades that just cut scrap. As used herein, product cutting blade or cutting blade means any cutting blade for cutting corrugated board that forms an edge on the final die cut product. As will be appreciated in subsequent portions of the disclosure, the product ejectors 64 are compressed as they move between the nip defined between the cylinder 40 and anvil cylinder 51. The product ejectors are compressed in the nip and as they exit the nip, they expand while engaging the die cut product and function to separate the die cut product from the cutting die. For completeness, subsequently herein other components of the rotary cutting die will be discussed.

Initially, however, the discussion is directed at supporting the product ejector 64. As is discussed below, the cutting die is provided with a relatively thin substrate that is secured to the inner surface 42B of the die board. The die board in turn is provided with product ejector openings 43 that extend completely through the die board. Product ejectors are seated on the outer surface of the substrate and are secured thereto. Thus, as will be discussed herein and as shown in the drawings, the product ejectors 64, once secured to the substrate, project outwardly therefrom through the product ejector openings 43 and past the outer surface 42A of the die board 42. See FIGS. 3 and 4. Thus, the product ejectors 64 are not supported or secured to the die board 42 itself. Rather, the product ejectors 64 are secured to the substrate that is secured to the inner surface 42B of the die board. Product ejectors 64 are constructed of compressible material. The compressible material includes, for example, rubber-like material that is a man-made elastomer with closed or hybrid cells.

With reference to the drawings, the die board 42 is provided with a series of product ejector openings 43. Product ejector openings 43 extend completely through the die board 42 and are open to the inner surface 42B, as well as the outer surface 42A. A substrate is secured to the inner surface 42B of the die board 42. The substrate can vary in material and size. However, in a preferred embodiment, the substrate is relatively thin and, when secured to the inner surface 42B of the die board, the substrate is sandwiched between the die cylinder 40 and the die board 42. As will be discussed herein, the substrate can be constructed of various materials. Examples of potential substrate materials are vulcanized rubber, cloth, metal such as aluminum, mylar, plastic, reinforced fiber, and tape, including tape that is manufactured with an adhesive backing or surface. There are various ways of securing the substrate to the inner surface 42B of the die board. In one example discussed herein, an adhesive or glue is used to secure the substrate to the die board. When a tape having an adhesive backing or surface is used, this adhesive backing or surface is directly applied to the die board.

Figure 2A:
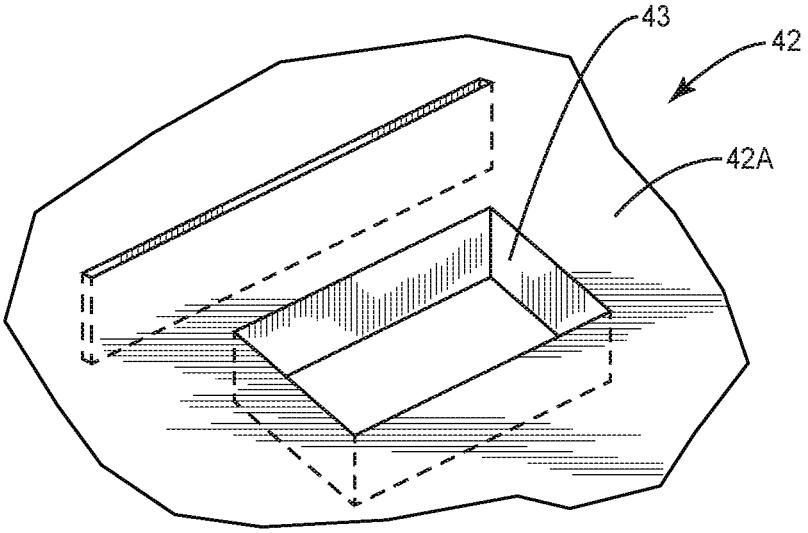
FIG. 2A is a fragmentary perspective view showing a portion of a die board having a product ejector opening formed completely through the die board.
Figure 2B:
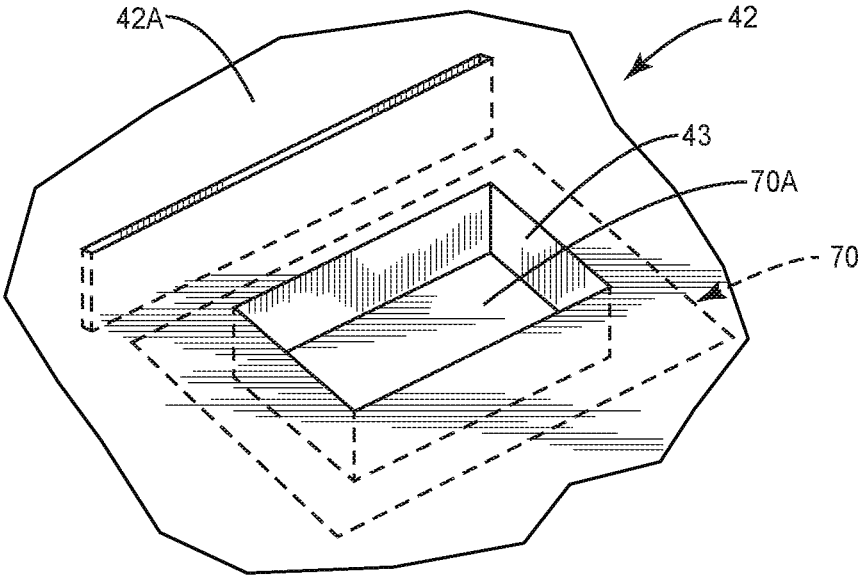
FIG. 2B is a fragmentary perspective view showing a die board having a substrate secured to the inner surface of the die board and aligned with the product ejector opening.
Figure 2C:
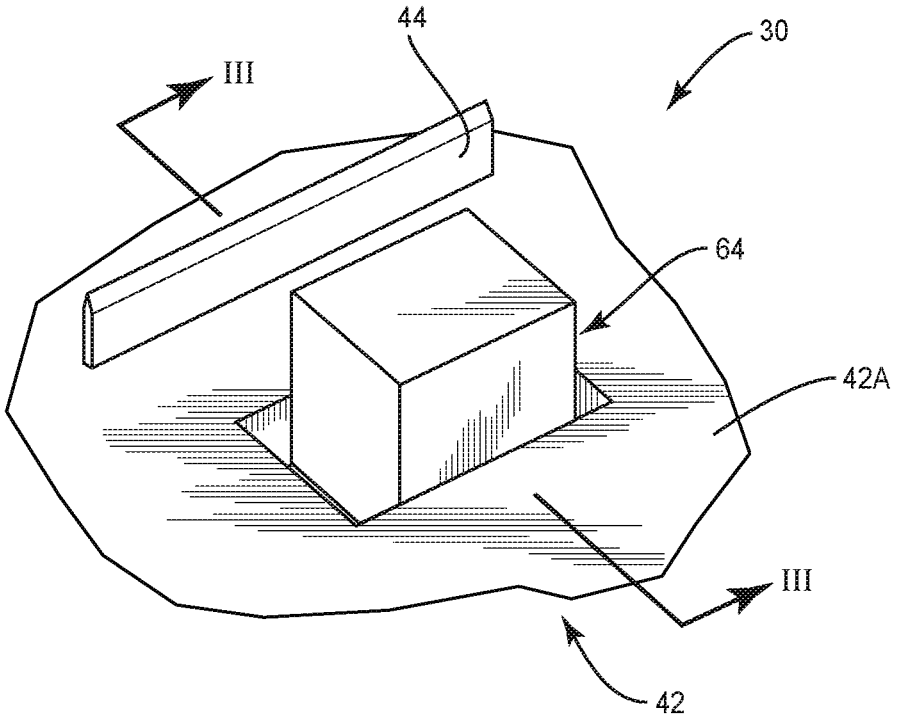
FIG. 2C is a view similar to FIG. 2B but showing a product ejector secured to the underlying substrate.
Figure 3:
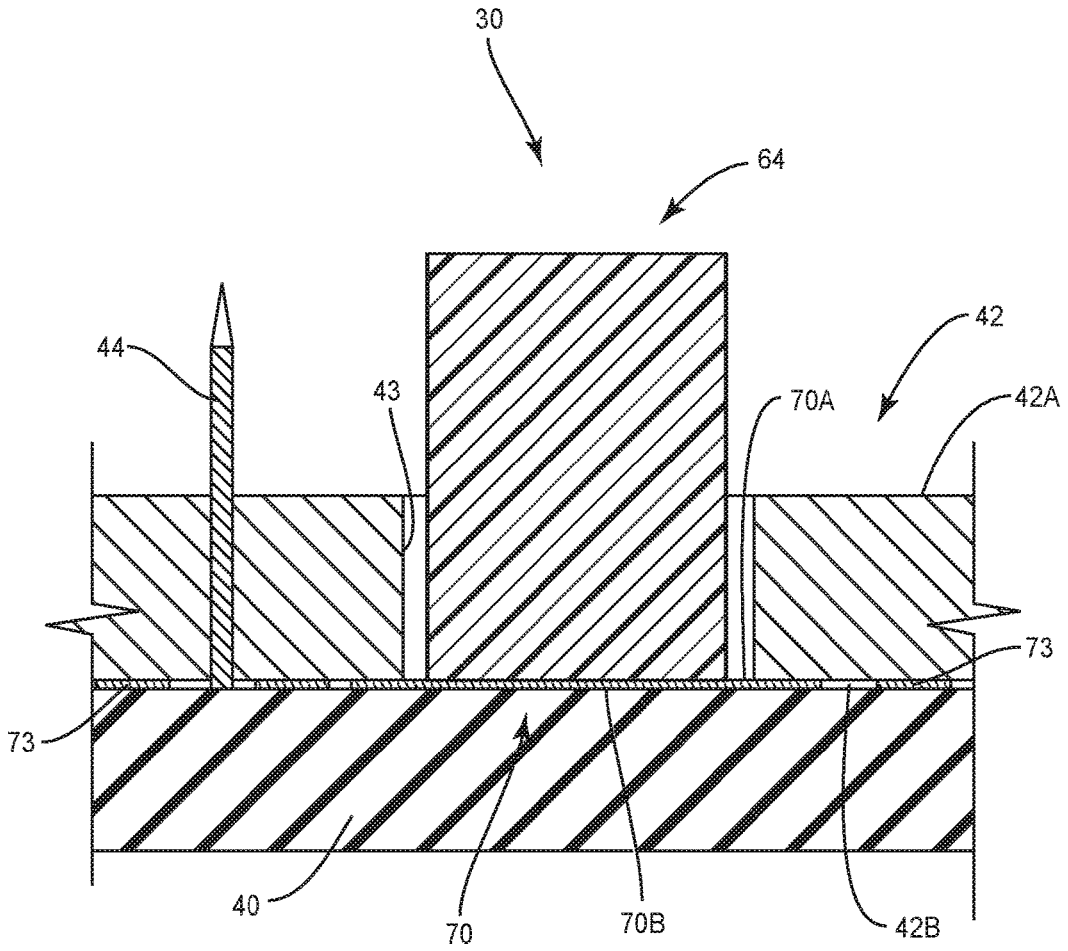
FIG. 3 is a sectional view taken along the line III-III.

Discussed herein are two examples of a substrate that can be employed for supporting the product ejectors 64 and for effectively maintaining the product ejectors about the die board 42. The first example is shown in FIGS. 2A-2C and FIG. 3. Shown therein is a portion of the die board 42. Note the product ejector opening 43 formed completely through the die board 42. The opening can be rectangular, square or round, or it can assume various other shapes. In this example, the substrate is a flexible piece or segment of tape indicated generally by the numeral 70. As shown in FIGS. 2B and 3, the tape 70 is secured around product ejector opening 43. The tape extends at least slightly outwardly from the opening 43 which results in a margin of tape that is sufficient to provide ample securement to the die board. In this example or embodiment, the tape 70 includes an adhesive surface 70A. This effectively forms an outer surface of the tape 70. It is referred to as an outer surface because it faces outwardly through the product ejector opening 43. The other side of tape 70 is referred to as a non-adhesive surface or backing 70B. When secured to the inner surface 42B of the die board, the non-adhesive surface or backing lies adjacent and engages the cylinder 70. Various tapes without an adhesive side can be used. In these cases, if preferred, an adhesive or glue can be applied to one of the sides of the tape. Also, the tape secured to the die board may be a multi-ply tape or a series of tapes can be applied one over the other. Also, the tape secured to the die board alone or as a part of a multi-ply tape structure can be reinforced with various materials including fiber, fiberglass, and other known tape reinforcing materials.

A product ejector 64 is secured to the adhesive surface 70A. This can be accomplished prior to the tape 70 being secured to the die board 42 or can be accomplished after the tape has been secured to the die board. Once secured to the adhesive surface 70A of the flexible tape 70, the product ejector 64, as seen in FIG. 2C, projects from the tape 70 through the product ejector opening 43 and past the outer surface 42A of the die board.

In this example, the flexible tape 70 is a single segment sized to cover one product ejector opening 43 and designed to support a single product ejector 64. However, it will be appreciated by those skilled in the art that the size of the tape segment can vary and be sufficiently large to cover multiple openings 43. In these cases, a single segment of the tape 70 supports a multiplicity of product ejectors 64. In other cases where there is multiple product ejector openings, multiple segments of the tape 70 can be employed with each segment covering one or more product ejector openings 43 and hence supporting one or more product ejectors 64. As shown in FIG. 3, the tape can be applied to the die board 42 in spots 73 and in areas where there is no product ejector opening. The purpose of applying tape in areas where there are no product ejector openings is that the tape in these areas tends to fill the gap between the die board 42 and the cylinder 40 and generally prevents or reduces the bouncing and flexing of the die board which can result in rules or cutting blades being damaged or broken.

Those skilled in the art will appreciate that various types of tapes can be used. The thickness of the tapes can vary. In one preferred embodiment, the tape has a thickness of approximately 0.002 to approximately 0.006 inches. Tape 70 can be constructed of various materials that are flexible and pliable and easy to use and apply. In one example, the tape 70 can be an aluminum-based tape such as the type commonly used to seal HVAC ducts.

Figure 4:
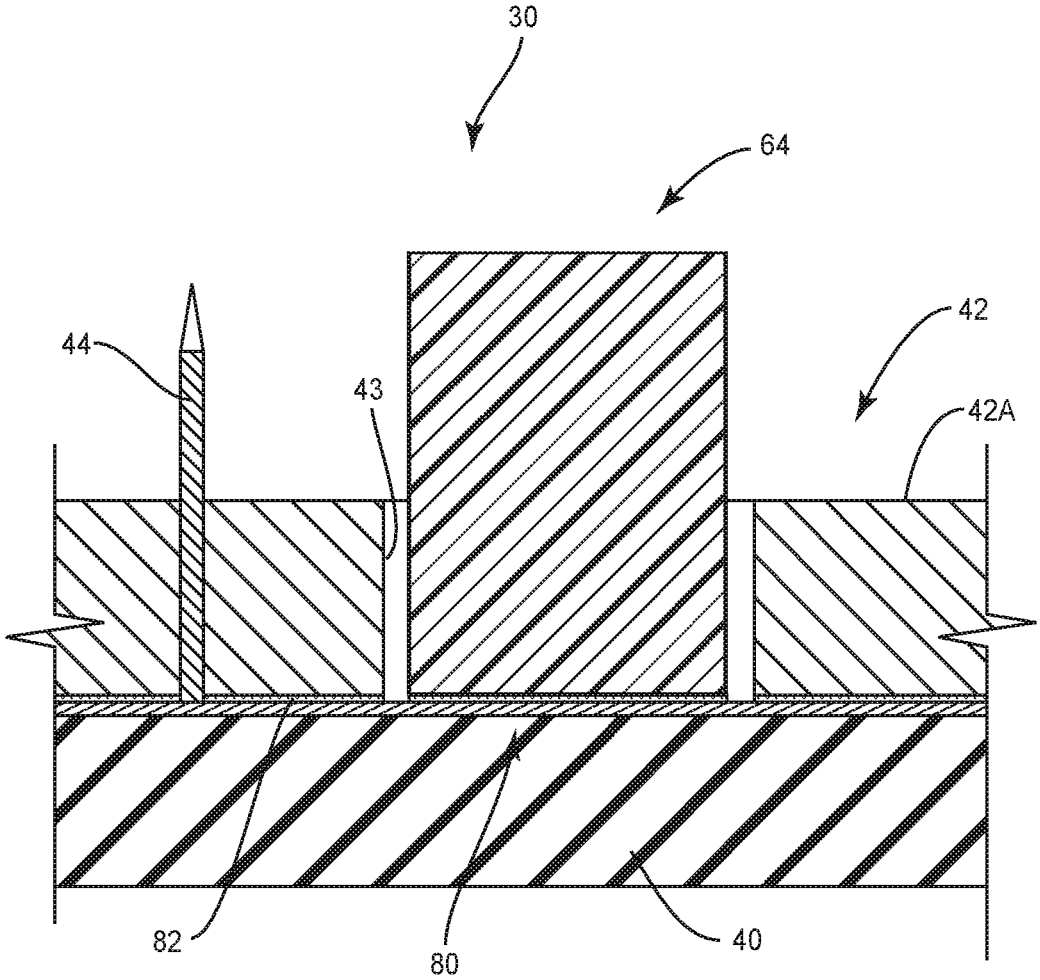
FIG. 4 is a cross-sectional view similar to FIG. 3 but showing an alternate embodiment for the substrate that has the product ejector secured thereto.
Figure 5:
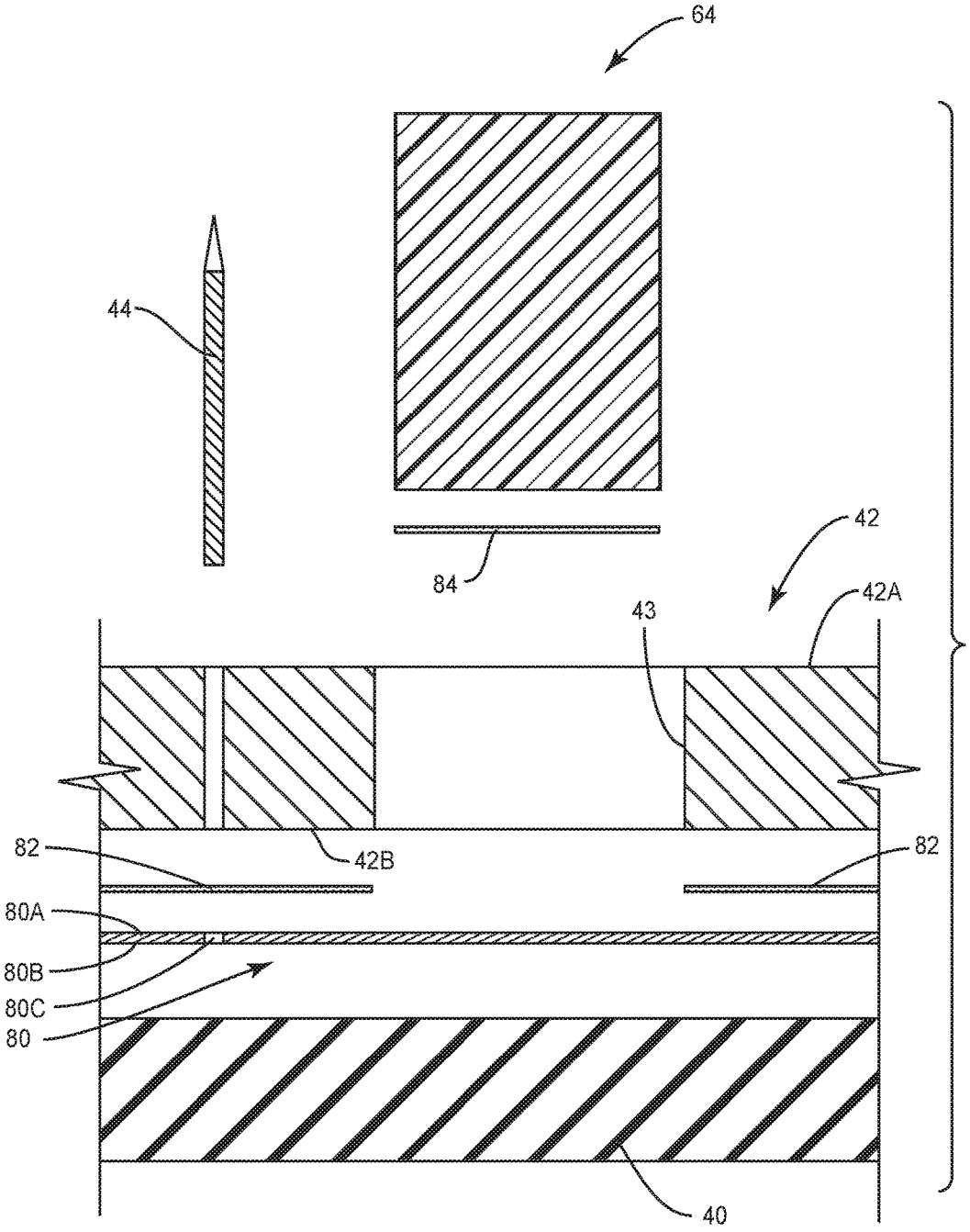
FIG. 5 is an exploded view of the assembly shown in FIG. 4.

There are other forms of substrates that can be used. FIG. 4 shows a fragmentary cross-section of a portion of a rotary cutting die where the substrate is indicated generally by the numeral 80 and extends over the entire area or over a large area of the inner surface 42B of the die board 42. In this case, the substrate includes an outer surface 80A, an inner surface 80B and one or more openings 80C to accommodate one or more product cutting blades 44 mounted in the die board 42. In this embodiment, substrate 80 is glued or secured by other suitable means to the inner surface 42B of the die board. In this case, an adhesive layer or glue layer 82 is used to glue the substrate 80 to the die board 42 as shown in FIGS. 4 and 5. Thus, in this case, the substrate 80 extends over a substantial area of the die board and covers the product ejector openings 43 aligned therewith. As shown in FIG. 4, a product ejector 64 is secured to the substrate 80 by the same adhesive layer 82 or by another adhesive or glue layer if desired. In one embodiment, a first glue layer could be applied to the substrate 80 for the purpose of securing the substrate 80 to the die board 42, leaving the areas aligned with the product ejector openings 43 generally free of adhesive or glue. Then another adhesive or glue layer 84 could be applied in the areas underlying the product ejector openings. See FIG. 5. The adhesive or glue used to glue the substrate 80 to the die board or product ejectors 64 could be the same or could be different adhesives. In any event, in some embodiments, there are multiple product ejector openings 43 and multiple product ejectors 64 secured to the underlying substrate 80. Because it is desirable for the product cutting blades 44 to engage the cylinder 40, it may be desirable to provide openings 80C strategically placed in the substrate 80 to permit the non-cutting end of these blades to engage the cylinder 40.

Various cutting and manufacturing processes can be employed to produce the rotary cutting die 30 described herein. In one process, for example, a laser can be employed to cut the product ejector openings 43 in the die board. Then the substrate can be secured to the die board and a laser can be employed to cut the blade openings in both the die board and the substrate. In another example, a laser can be utilized to cut all die fastener, blade/rule and product ejector openings in the die board. Next, the process may use a CNC router to cut the substrate and to provide the blade/rule and bolt hole openings in the substrate. Now the substrate can be secured or glued to the inner surface 42B of the die board. As people skilled in the art will appreciate, there are other approaches to appropriately cutting the substrate 80 in order that the substrate functionally aligns with the die board.

There are numerous advantages to employing a substrate as described herein to support and secure the product ejectors 64. First, this tends to maximize the height or length of the product ejectors 64 and because of that, it is easier to design and specify product ejectors so as to control and limit the pressure applied to the die cut product to avoid crushing the flutes. The product ejectors can now be compressed and expanded without directly impacting the die board. Indeed, the product ejectors can work and function while being supported and secured to the relatively thin substrate sandwiched between the die board and the cylinder 40.

Now that the substrate has been discussed along with how the product ejectors are secured to the substrate, it may be beneficial to briefly review the basic structure and function of the rotary cutting die apparatus shown in FIG. 1. This will give a more complete and unified understanding of how corrugated board is cut and/or scored and some context with respect to the function of the product ejectors 64. With particular reference to FIG. 1, the rotary cutting die apparatus 30 includes the die cylinder 40 and the anvil cylinder 51. Die cylinder 40 is designed to receive and hold the curved die board 42. Die cylinder 40 and the die board 42 are disposed with respect to the anvil cylinder 51 such that the nip is defined between the cylinder 40 and the anvil surface. As sheets of corrugated board CB are fed through the nip, the corrugated board is engaged by the die board 42 which trims, cuts and scores the corrugated board. Anvil cylinder 51 is typically surrounded by the sheath 52 which is a relatively durable material (such as urethane) that provides a backing surface. As such, the anvil cylinder 51 rotates in a manner that is generally synchronous with the adjacent die board cylinder 40 during normal operations.

Die board 42 is typically constructed of laminated plywood. Die boards, such as that illustrated in FIG. 1, typically include a combination of cutting blades, scoring rules, resilient scrap strippers and product ejectors. With reference to FIG. 1, a typical die board 42 is shown therein. Die board 42, as noted above, is curved to fit the die cylinder 40.

In the exemplary die board 42 shown in FIG. 1, the die board has mounted thereto a series of product cutting blades 44. Cutting blades 44 extend around the die board 42. Blades 44 function to cut the overall dimensions of a die cut product which can be manipulated to form a box. Thus, as seen in FIG. 1, a sheet of corrugated board CB is fed into the nip and as the corrugated board moves through the nip, the blades 44 will cut and form the die cut product.

Also, a typical die board, such as that shown in FIG. 1, includes scrap cutting blades and strippers to strip scrap from the scrap cutting blades. For example, scrap cutting blades can be used to cut holes, slots and openings in the die cut product. Therefore, it is appreciated that the scrap cutting blades and scrap strippers are typically disposed within the confines of blades 44. The product cutting blades 44 are not scrap blades. As used herein, the term "product cutting blade" means a blade that forms an edge on the final die cut product.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A rotary cutting die adapted to be mounted on a rotary die cylinder for cutting corrugated board fed into a nip disposed between the die cylinder and a rotating anvil to produce a die cut product, the rotary cutting die comprising:

a curved die board configured to be mounted to the cylinder and including inner and outer surfaces;

one or more product cutting blades mounted in the die board for cutting the corrugated board fed through the nip to produce the die cut product;

a product ejector opening formed in the die board and extending from the outer surface to the inner surface of the die board;

a flexible tape substrate having an adhesive surface that is secured to the inner surface of the die board and extending over the product ejector opening; and a product ejector constructed of compressible material and secured to the flexible tape substrate and extending outwardly from the flexible tape substrate and through the product ejector opening and past the outer surface of the die board for engaging a portion of the die cut product passing through the nip and exerting a force on the die cut product which assists in separating the die cut product from the cutting die.

2. The rotary cutting die of claim 1 wherein the flexible tape substrate is constructed, in part at least, of vulcanized rubber, cloth, metal, mylar, reinforced fiber, multi-ply material, or plastic.

3. The rotary cutting die of claim 1 wherein the flexible tape substrate includes an inner side and an outer side with the outer side facing the inner side of the die board; and wherein the outer side of the substrate includes the adhesive surface that secures the product ejector to the flexible tape substrate.

4. The rotary cutting die of claim 1 wherein the adhesive surface covers the product ejector opening adjacent the inner side of the die board.

5. The rotary cutting die of claim 4 wherein the flexible tape substrate has a thickness of 0.002-0.006 inches.

6. The rotary cutting die of claim 1 wherein the flexible tape substrate is constructed, in part at least, of aluminum.

7. The rotary cutting die of claim 1 including one or more cutting blade openings formed in the flexible tape substrate for permitting the one or more product cutting blades to project therethrough.

8. The rotary cutting die of claim 1 wherein the die board includes multiple product ejector openings and wherein the flexible tape substrate secured to the inner side of the die board extends over the multiple product ejector openings and wherein a series of product ejectors are secured to the flexible tape substrate and project outwardly therefrom through the multiple product ejector openings formed in the die board.

9. The rotary cutting die of claim 1 wherein the flexible tape substrate includes one or more product cutting blade openings aligned with the one or more product cutting blades mounted in the die board; and wherein the product cutting blades extend completely through the die board and through the product cutting blade openings in the flexible tape substrate.

10. The rotary cutting die of claim 1 wherein the product cutting blade extends through the die board and engages the substrate without penetrating through the flexible tape substrate.

11. A rotary cutting die adapted to be mounted to a rotary die cylinder for cutting corrugated board fed into a nip disposed between the die cylinder and a rotating anvil to produce a die cut product, the rotary cutting die comprising:

a curved die board configured to be mounted to the cylinder and including inner and outer surfaces;

one or more product cutting blades mounted in the die board for cutting the corrugated board fed through the nip to produce the die cut product;

one or more product ejector openings formed completely through the die board and extending from the inner surface to the outer surface of the die board;

a flexible tape having an adhesive surface that is secured to the inner surface of the die board and extending over the product ejector opening; and a product ejector constructed of compressible material and secured to the flexible tape and extending outwardly therefrom through the product ejector opening and past the outer surface of the die board for engaging a portion of the die cut product passing through the nip and exerting a force on the die cut product which assists in separating the die cut product from the cutting die.

12. The rotary cutting die of claim 11 wherein the flexible tape includes the adhesive surface on one side thereof.

13. The rotary cutting die of claim 11 including spots of the tape secured to various areas of the inner surface of the die board and not associated with a product ejector opening.

14. The rotary cutting die of claim 11 wherein the flexible tape is constructed, in part at least, of aluminum.

15. The rotary cutting die of claim 14 wherein the flexible tape includes a thickness of approximately 0.002-0.006 inches.

16. The rotary cutting die of claim 11 wherein the flexible tape is constructed, in part at least, of vulcanized rubber, cloth, metal, mylar, reinforced fiber, multi-ply material, multiple plies of tape applied one over the other, or plastic.

17. The rotary cutting die of claim 11 wherein the die board includes multiple product ejector openings and wherein there is one or more segments of the flexible tape adhered via the adhesive surface thereof to the inner side of the die board and underlying the product ejector openings and wherein a series of product ejectors are secured to the adhesive surface of the flexible tape and project outwardly therefrom through the multiple product ejector opening in the die board.

18. A method of constructing a rotary cutting die that cuts corrugated board into die cut products comprising:

forming a series of product ejector openings through a curved die board wherein the product ejector openings extend completely through the curved die board and extend from an outer surface of the die board to an inner surface of the die board;

securing one or more flexible tape substrates each with one or more segment of adhesive surfaces to the inner surface of the die board such that the one or more substrates extend over the product ejector openings in the die board;

mounting one or more product cutting blades in the die board for cutting the corrugated board into the die cut products; and securing a series of product ejectors to the one or more flexible tape substrates and projecting the product ejectors from the one or more substrates through the product ejector openings in the die board and past the outer surface of the die board such that the product ejectors extend outwardly from the outer surface of the die board.

19. The method of claim 18 wherein the the method further including applying the adhesive surface of the one or more segments of flexible tape to the inner surface of the die board such that the one or more segments of flexible tape cover the product ejector openings.

20. The method of claim 19 including securing the product ejectors to the adhesive surface of the one or more segments of flexible tape and projecting the product ejectors from the flexible tape through the product ejector openings in the die board and past the outer surface of the die board.

21. The method of claim 18 wherein the flexible tape substrate is constructed, in part at least, of aluminum and having a thickness of approximately 0.002 -0.006 inches.

22. The method of claim 18 wherein the one or more flexible tape substrates include product cutting blade openings formed therein for enabling product cutting blades secured to the die board to project therethrough.

23. The method of claim 18 wherein the cutting blades engage the flexible tape substrate without penetrating into the substrate.

* * * * *